US007551889B2

(12) United States Patent
Quelle

(10) Patent No.: US 7,551,889 B2
(45) Date of Patent: Jun. 23, 2009

(54) METHOD AND APPARATUS FOR TRANSMISSION AND RECEIPT OF DIGITAL DATA IN AN ANALOG SIGNAL

(75) Inventor: Hans-Christoph Quelle, Düsseldorf (DE)

(73) Assignee: Nokia Corporation, Espoo (FI)

( * ) Notice: Subject to any disclaimer, the term of this patent is extended or adjusted under 35 U.S.C. 154(b) by 676 days.

(21) Appl. No.: 10/879,126

(22) Filed: Jun. 30, 2004

(65) Prior Publication Data

US 2006/0003694 A1 Jan. 5, 2006

(51) Int. Cl.
*H04H 40/00* (2008.01)

(52) U.S. Cl. ..... 455/3.06; 455/3.01; 455/414.4; 455/553.1

(58) Field of Classification Search ..... 455/3.01, 455/3.03, 3.06, 11.1, 18, 102, 93, 73, 92, 455/552.1, 127.4, 142, 67.7, 556.1, 188.1, 455/418, 414.4, 419, 553.1, 143, 522.1, 67.11, 455/77, 414.1, 466; 707/3, 104.1; 725/18, 725/19

See application file for complete search history.

(56) References Cited

U.S. PATENT DOCUMENTS

| | | | | |
|---|---|---|---|---|
| 4,703,465 | A * | 10/1987 | Parker | 369/84 |
| 5,406,626 | A | 4/1995 | Ryan | |
| 5,410,344 | A | 4/1995 | Graves et al. | |
| 5,524,051 | A | 6/1996 | Ryan | |
| 5,590,195 | A | 12/1996 | Ryan | |
| 5,751,806 | A | 5/1998 | Ryan | |
| 5,809,472 | A | 9/1998 | Morrison | |
| 5,815,671 | A | 9/1998 | Morrison | |
| 5,956,629 | A | 9/1999 | Morrison | |
| 5,963,916 | A | 10/1999 | Kaplan | |
| 5,986,200 | A | 11/1999 | Curtin | |
| 6,167,253 | A | 12/2000 | Farris et al. | |
| 6,188,398 | B1 | 2/2001 | Collins-Rector et al. | |

(Continued)

FOREIGN PATENT DOCUMENTS

| | | |
|---|---|---|
| CA | 2192958 | 11/2002 |

(Continued)

OTHER PUBLICATIONS

FT Interactive Data, printed from http://www.interactivedata.com/images/IDC_timeline.swf, on Mar. 14, 2005, 4 pages.

(Continued)

*Primary Examiner*—John J. Lee
(74) *Attorney, Agent, or Firm*—Banner & Witcoff, Ltd.

(57) ABSTRACT

Methods and apparatuses for processing transmissions and creating an album of audio content are described. In one arrangement, a combined signal including a digital data component and an analog component is transmitted and received by a terminal. The combined signal is separated into the digital data component and the analog component. The analog component is digitized and then cut based upon the digital data component. Metadata from the digital data component is associated with the digitized analog component to create an album of audio content. The album may be stored or sent to an audio player for output. The digital data component may include cutting information and information data. The analog component may be an analog frequency modulation signal and the digital component may be a subcarrier signal in accordance with the DARC standard.

29 Claims, 12 Drawing Sheets

U.S. PATENT DOCUMENTS

| | | | | |
|---|---|---|---|---|
| 6,192,340 | B1 | 2/2001 | Abecassis | |
| 6,195,692 | B1 | 2/2001 | Hsu | |
| 6,199,076 | B1 | 3/2001 | Logan et al. | |
| 6,202,062 | B1 | 3/2001 | Cameron et al. | |
| 6,208,335 | B1 | 3/2001 | Gordon et al. | |
| 6,248,946 | B1 | 6/2001 | Dwek | |
| 6,260,192 | B1 | 7/2001 | Rosin et al. | |
| 6,314,094 | B1 | 11/2001 | Boys | |
| 6,330,334 | B1 | 12/2001 | Ryan | |
| 6,389,467 | B1 | 5/2002 | Eyal | |
| 6,430,537 | B1 | 8/2002 | Tedesco et al. | |
| 6,470,378 | B1 | 10/2002 | Tracton et al. | |
| 6,490,432 | B1 | 12/2002 | Wegener et al. | |
| 6,502,194 | B1 | 12/2002 | Berman et al. | |
| 6,539,395 | B1 | 3/2003 | Gjerdingen et al. | |
| 6,563,880 | B1 * | 5/2003 | Hunsinger et al. | 375/260 |
| 6,567,660 | B1 | 5/2003 | Wegener | |
| 6,587,127 | B1 | 7/2003 | Leeke et al. | |
| 6,608,994 | B1 | 8/2003 | Wegener et al. | |
| 6,609,097 | B2 | 8/2003 | Costello et al. | |
| 6,622,007 | B2 | 9/2003 | Linden | |
| 2002/0054597 | A1 * | 5/2002 | O'Toole et al. | 370/395.41 |
| 2003/0009765 | A1 | 1/2003 | Linden et al. | |
| 2003/0063125 | A1 * | 4/2003 | Miyajima et al. | 345/781 |
| 2003/0069032 | A1 | 4/2003 | Jarvi et al. | |
| 2004/0073916 | A1 * | 4/2004 | Petrovic et al. | 725/18 |
| 2004/0097194 | A1 | 5/2004 | Karr et al. | |
| 2004/0102213 | A1 | 5/2004 | Karr et al. | |
| 2004/0102214 | A1 | 5/2004 | Karr et al. | |
| 2004/0102215 | A1 | 5/2004 | Karr et al. | |
| 2004/0220926 | A1 * | 11/2004 | Lamkin et al. | 707/3 |
| 2004/0242163 | A1 | 12/2004 | Karr et al. | |
| 2005/0223039 | A1 * | 10/2005 | Kim et al. | 707/104.1 |

FOREIGN PATENT DOCUMENTS

| | | | |
|---|---|---|---|
| EP | 0688480 | B1 | 12/1995 |
| EP | 0689742 | B1 | 1/1996 |
| EP | 0 854 645 | A2 | 7/1998 |
| EP | 1037419 | A2 | 9/2000 |
| EP | 1037419 | A3 | 9/2000 |
| EP | 1059749 | A2 | 12/2000 |
| EP | 1059749 | A3 | 12/2000 |
| EP | 1107624 | A2 | 6/2001 |
| EP | 1107624 | A3 | 6/2001 |
| EP | 1126643 | A2 | 8/2001 |
| EP | 1126643 | A3 | 8/2001 |
| EP | 1187379 | A2 | 3/2002 |
| EP | 1187379 | A3 | 3/2002 |
| JP | 2000172484 | A | 6/2000 |
| WO | WO 83/03181 | | 9/1983 |
| WO | WO 99/35830 | | 7/1999 |
| WO | WO 01/74059 | A1 | 10/2001 |
| WO | WO 02/23773 | A2 | 3/2002 |
| WO | WO 02/23773 | A3 | 3/2002 |

OTHER PUBLICATIONS

Ankeny, Jason, "Safe At Any Speed", printed from http://wirelessreview.com/ar/wireless_safe_speed/, on 3 pages, Wireless, Jun. 1, 2004.

"Mobility and the Implications of Wireless Technologies," printed from http://www.wws.princeton.edu/cgi-bin/byteserv.prl/~ota/disk1/1995/9547/954705.PDF, chapter 2, pp. 47-64, Sep. 1995.

Welcome to eSignall, printed from http://www.esignal.com/default.asp, on Mar. 15, 2005, 2 pages.

Welcome to the QuoTrek Product Site!, printed from http://www.quotrek.com/ on Mar. 14, 2005, 2 pages.

Vaidya, Nitin H., et al., "Scheduling data broadcast in asymmetric communication environments," Wireless Networks, vol. 5, Issue 3, May 1999, pp. 171-182.

"New Flexible Network-based RTK Service in Japan," printed from http://www.geomatics.ucalgary.ca/~lachapel/00GPSIP.pdf, 8 pages, Approximate Publication: after 1999.

"Semiconductor Delivers Complete Solution for Microsoft's New Smart Personal Objects Technology Initiative," printed from http://www.national.com/news/item/0,1735,829,00.htm on Mar. 28, 2005, 30 pages.

American Meteorological Society, "Unidata's Internet Data Distribution (IDD) System: Two Years of Data Delivery," printed from http://www.unidata.ucar.edu/projects/idd/iips97.mitch.html, 6 pages, 1997.

Unidata—IDD Principles, "Principles Underlying Internet Data Distribution," printed from http://www.unidata.ucar.edu/projects/idd/plans/principles.html, 3 pages, Jun. 29, 1994.

Screenshots of www.musicmatch.com, Dec. 3, 1998-Feb. 2, 1999 [retrieved Apr. 6, 2004], pp. 1-3, retrieved from: google.comand archive.org.

"MusicMatch delivers breakthrough music personalization service in new musicmatch jukebox", press release from www.musicmaker.com, Feb. 22, 2000 [retrieved Apr. 6, 2004], 2 pages, retrieved from: archive.org and google.com.

"MusicMatch and Xing Technology Introduce MusicMatch Jukebox", press release from www.musicmaker.com, May 18, 1998 [retrieved Apr. 6, 2004], 2 pages, retrieved from: archive.org and google.com.

"Rio PMP 300", Screenshots of www.diamonmm.com, Apr. 29, 1999 [retrieved Apr. 8, 2004], pp. 1-14, retrieved from: google.com and archive.org.

":Radio broadcasting systems: DAta Radio Channel (DARC); System for wireless infotainment forwarding and teledistribution," ETSI EN 300 751, Jan. 2003, pp. 1-75, V1.2.1, European Broadcasting Union—Union Européenne de Radio-Télévision (EBU-UER).

Rothblatt, Martin, "Talking stars and talking cars," Satellite Communications, Jun. 1990, p. 12, V. 14, No. 6, Gale Group Trade & Industry DB.

Lambert, Peter, "FCC puts satellite DAB plan up for comment. (Federal Communications Commission, Digital Audio Broadcasting) (Brief Article)," Broadcasting, Oct. 19, 1992, p. 28(1), vol. 122, No. 43, Gale Trade & Industry DB.

Scully, Sean, "The five vying for digital audio radio service," Broadcasting & Cable, Apr. 19, 1993, p. 54(2), vol. 123, No. 16, Gale Group Trade & Industry DB.

"Widespread DAB Acceptance 'Probable,' Public Radio Survey Says," Audio Week, Jun. 7, 1993, 2 pages, vol. 5, No. 22, Gale Group Newsletter DB™.

"Japanese Copyright Groups to Seek Higher Fees on DAB," Audio Week, Sep. 27, 1993, 3 pages, vol. 5, No. 37, Gale Group Newsletter™.

Farhi, Paul, "Music From the Spheres; Two Local Companies Go Head to Head to Develop Pay Satellite Radio," The Washington Post, May 19, 1997, 3 pages, F05.

Newell, Brian, "Grundig: DAB—Just another gimmick or a real benefit to the (in-car) consumer,?" M2 Presswire, Jul. 17, 1997, 2 pages, vol. 17, Gale Group Newsletter DB™.

Doward, Jamie, "Radio's DAB hands tune in for a revolution: Digital audio broadcasting is riding on the crest of a wave to a new wireless medium, says Jamie Doward," Observer, Aug. 3, 1997, p. 5, Dialog Global Reporter.

"Technology Giants Join Forces with New Jersey Firms on Internet Telephony (Microsoft Corp. has made equity investments in Audible Inc. and Dialogic Corp., while Netscape Communications has invested in IDT Corp,; all three companies have developed voice over IP technology)," Star-Ledger, Mar. 12, 1999, 2 pages, Business & Industry®.

Hogan, Monica, "Satellite Radio Start-Ups Seek Subscribers," Multichannel News, Jun. 21, 1999, p. 50, vol. 20, No. 26, Gale Group Promt®.

"MusicMatch and Xing Technology Introduce Musicmatch Jukebox, Digital Music Management Software Turns Personal Computers Into Home Stereo Components," press release from http://www.musicmatch.com/info/company/press/releases/?year=1998&release=2, May 18, 1998, [retrieved Sep. 11, 2002], 1 page.

"PC Radio Screen," http://www.atlanticradio.fr/us/RS_PC_TECH.htm and CitySurfer in http://www.sectra.se/wireless/darc/product_family/citysurfer_drt4000.html [printed May 28, 2004].
Screenshots from Applian Technologies Replay Music, The Ultimate Streaming Music Recorder, http://www.replay-music.com/?src=GRM_RECORDRADIO [printed Jun. 2, 2004].
Screenshot from Visual Radio, Redefining the Radio Experience, "Why is it Cool?" http://www.visualradio.com/why.html [printed Jun. 2, 2004].
Screenshot from Visual Radio, Redefining the Radio Experience, "How Does It Work?" http://www.visualradio.com/how.html [printed Jun. 2, 2004].
Screenshots from Focus, Archos Ondio Mini MP3/Voice Player/Recorder/FM Radio sales, http:/www.focuscamera.com/camera-store/Archos-Ondio-Mini-MP3-Voice-Player-Recorder-FM-Radio-500324.html [printed Jun. 2, 2004].
Screenshots from Ciaol, http://www.ciao.co.uk/MP3_Players_5220788_4-mp3_player_player_recorder_radio [printed Jun. 2, 2004].
Screenshots from Notebookshop.com; http://www.notebookshop.com/store/Product1.asp?Product_id=471, [printed Jun. 2, 2004].
Screenshots from Pogo! Products, "Ripdrive", http://www.pogoproducts.com/ripdrive.html, [printed Jun. 2, 2004].
Screenshot from MobileMag, PoGo! Products Releases Radio YourWay Digital AM/FM Radio Recorder, Tuesday, Apr. 29, 2003, http://www.mobilemag.com/content/100/337/C1666/, [printed Jun. 2, 2004].
Screenshots from Audio/Video Software, "Audio Converter/Audio Grabber 4.0", http://www.audiosoftware.org/AudioConverter.htm, [printed Jun. 2, 2004].
Screenshots from XIPH.org, Vorbis.com, Icecast.org, Speex.org, "Open Standards for Internet Multimedia," http://www.vorbis.com/, [printed Jun. 2, 2004].
"What is New With Thiecom ©, (. . . and the scanners—world . . . )," 5 pgs, translated version of http://www.thiecom.com/wasistneu1999.htm.
Screenshot regarding "SRF-DR2000 Walkmanradio", Oct. 20, 1999, http://www.nozema.nl/nieuws/Archief/ArchiefOverig/NozemaActueel201099.html, [printed Jun. 28, 2004] and translation.
ITU-R Recommendation B5, 1194-2 (Dec. 1995), "System for Multiplexing FM Sound Broadcasts with a Subcarrier Data Channel Having a Relatively Large Transmission Capacity for Stationary and Mobile Reception".
"The Sound of things to come", ampcast.com, Nov. 16, 1999 [retrieved Oct. 10, 2003], 1 page, retrieved from: google.com and archive.org.
"Nielson Media Research", www.nielsenmedia.com, Feb. 2, 1998 [retrieved Oct. 10, 2003], pp. 1-22, retrieved from: google.com and archive.org.
"MP3 playlist maker", Sassner.com, May 8, 1999 [retrieved on Oct. 10, 2003], pp. 1-9, retrieved from: google.com and archive.org.
"Home of Audi-Video Softwares Up to Date", MPEGX.com, Oct. 12, 19999 [retrieved on Oct. 10, 2003], pp. 1-13, retrieved from: google.com and archive.org.
"Microsoft: Cirrus and Microsoft to enable portable music devices based on Windows media Technology", M2 Presswire, Sep. 28, 1999 [retrieved Jan. 19, 2003], 3 pages, Retrieved from: Dialog, file 636.

* cited by examiner

METHOD AND APPARATUS FOR TRANSMISSION AND RECEIPT OF DIGITAL DATA IN AN ANALOG SIGNAL

FIELD OF THE INVENTION

The invention relates to analog broadcast services. More particularly, the invention relates to systems, methods, and apparatuses for transmitting and receiving data from an analog audio signal for automatic creation of an album of audio content.

BACKGROUND OF THE INVENTION

Broadcast transmission has been a staple in communication and reaching a large number of people for many years. In the United States alone, there a hundreds of radio and television broadcasters transmitting modulated signals, such as amplitude modulation (AM) signals, frequency modulation (FM) signals, very high frequency (VHF) signals, and ultra high frequency (UHF) signals for transmission of audio and/or video content. Many different types of devices exist that can receive analog audio signals, such as an FM signal, and produce music and/or other audio content through a speaker. Examples of such terminal devices include radios, computers, and cellular telephones. Today, terminal devices allow users the ability to record a broadcast analog transmission that is received by the terminal device.

A Digital transmission often includes information regarding the transmission as such is necessary for the receiver device to be able to properly process the incoming digital data. This information is often referred to as metadata. Typically, metadata for digital music includes the artist and title of the song. However, for analog transmissions, information about the analog transmission is not sent in parallel with the analog transmission itself. Typically, if any information regarding an analog transmission is associated with the analog transmission, it is done upon arrival at the receiver device and/or manually by a user. FIGS. 1A and 1B show two systems that are used today to associate information about an audio entity, such as a song, with the actual entity.

FIG. 1A illustrates a receiver system where a user must enter any metadata for association with an audio entity by hand. As shown, an analog FM transmission is transmitted to an analog FM receiver 120. Analog FM receiver processes the analog FM signal 110 and sends the signal to a recorder 130. Recorder 130 stores the analog FM signal 110 in some type of storage medium. Metadata insertion engine 140 may be a program that allows a user to enter title information or artist information about the stored analog FM signal. A user may have heard of the particular song before and knows the artist that recorded it. The manually entered metadata can then be associated with the analog FM signal and sent to an audio player or stored in some type of storage medium. As illustrated in FIG. 1B, recorder 130 may access a memory space that contains stored metadata 145. In such a case, the system can associate metadata information, such as the song title or artist, with the analog FM signal and send to an audio player or store in some type of storage medium 150. In either case, any information that corresponds to the transmitted analog FM signal 110 is generated and associated by the terminal device. If there is no stored metadata 145 or manual entry of metadata by a metadata insertion engine, a user can not readily determine the song tile or artist name without listening to the recorded song. In conventional systems, recordings from an analog source do not have associated metadata.

BRIEF SUMMARY OF THE INVENTION

It would be an advancement in the art to provide a method and system for transmitting digital data, e.g., metadata, in parallel with an analog audio stream, thereby allowing a user to automatically record analog audio transmissions and have information about the audio transmissions be associated automatically. To overcome limitations in the art described above, and to overcome other limitations that will be apparent upon reading and understanding the present specification, the present invention is directed to a system and method for transmitting and receiving an analog transmission coupled with a digital data signal.

According to one aspect of the present invention, a combined signal including a digital data component and an analog component is transmitted and received by a terminal. The combined signal is separated into the digital data component and the analog component. The analog component is digitized and then cut based upon the digital data component. Metadata from the digital data component is associated with the digitized analog component to create an album of audio content. The album may be stored or sent to an audio player for output. The digital data component may include cutting information and information data. The analog component may be an analog frequency modulation signal and the digital component may be a subcarrier signal in accordance with the Data Radio Channel (DARC) standard.

Another aspect of the present invention includes a terminal with a receiver configured to receive a combined analog signal and subcarrier signal, a processor for controlling operation of the terminal, the processor configured to process the received subcarrier signal and analog signal by software programmed to generate an album of audio content, a digital player configured to output the album of audio content, a storage medium configured to store the album of audio content, a display configured to show information relating to the album, and an interface configured to allow a user to interface with the terminal.

Still another aspect of the present invention includes a broadcast system for transmitting a transmission including a digital data component and an analog component. The system may include a signal insertion engine configured to combine an analog component with a digital data component and a transmitter configured to transmit the combined analog component and digital data component. The digital data component may include metadata and cutting information and the digital data component may be a subcarrier signal in accordance with the DARC standard.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1A:
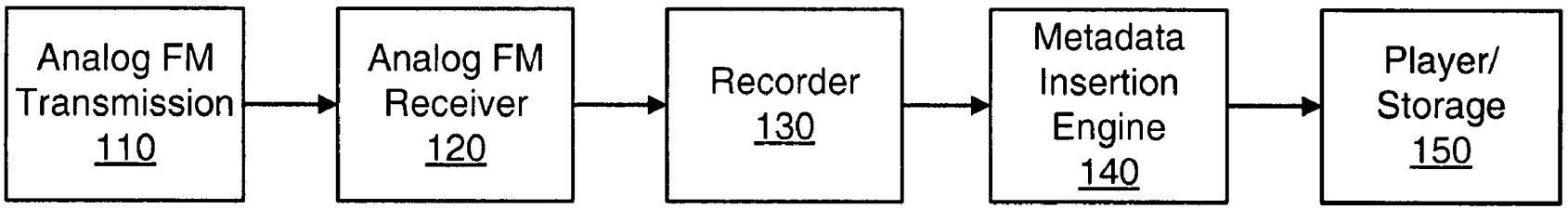
FIGS. 1A and 1B illustrate block diagrams of systems for associating metadata with an analog FM broadcast.
Figure 1B:
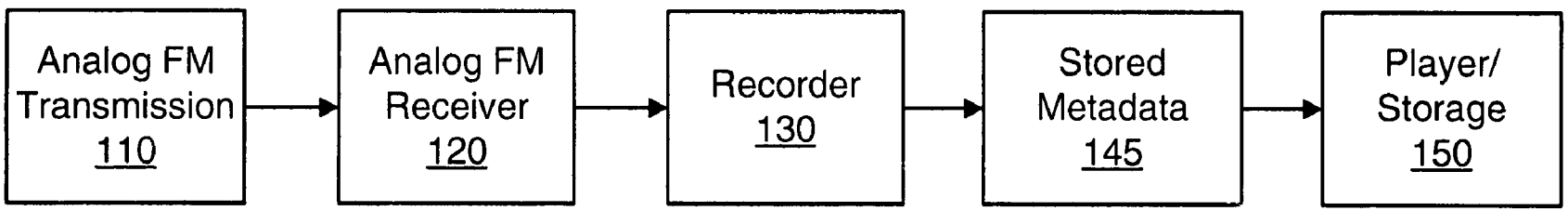
Figure 2A:
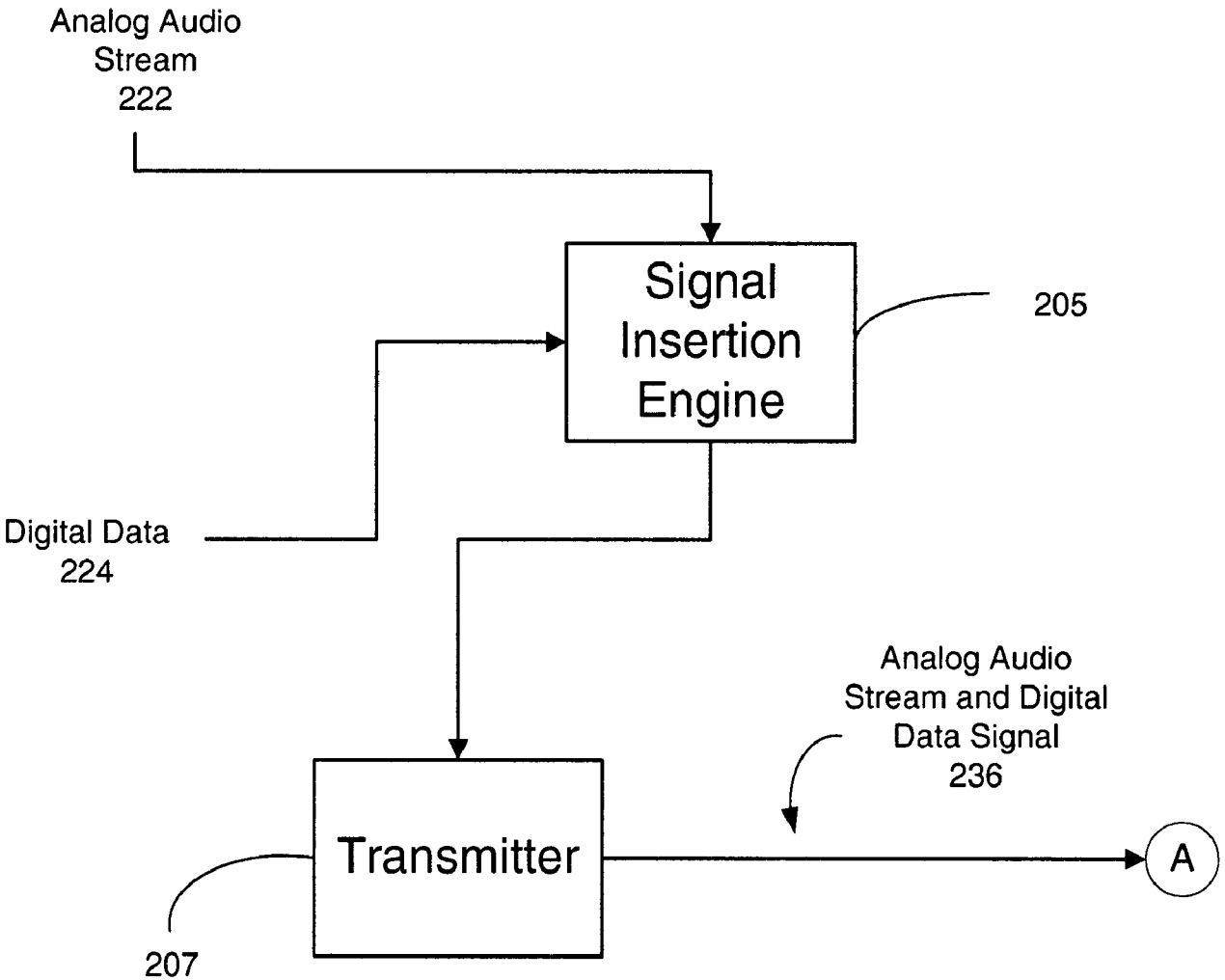
FIG. 2A illustrates a block diagram of a system for transmitting digital data with an analog audio stream in accordance with at least one aspect of the present invention.
Figure 2B:
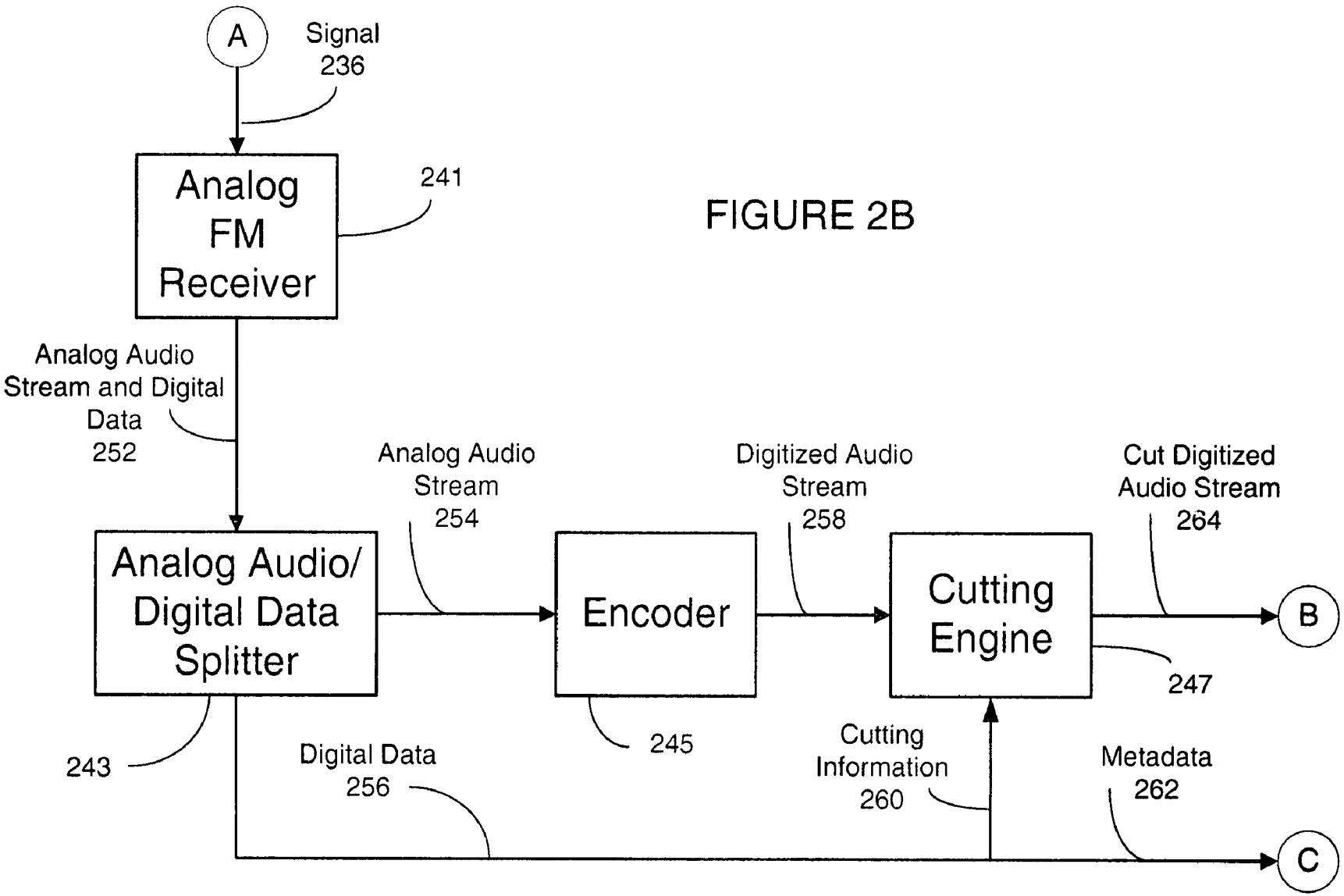
FIGS. 2B and 2C illustrate block diagrams of a system for receiving and processing a digital data and analog audio stream in accordance with at least one aspect of the present invention.
Figure 2C:
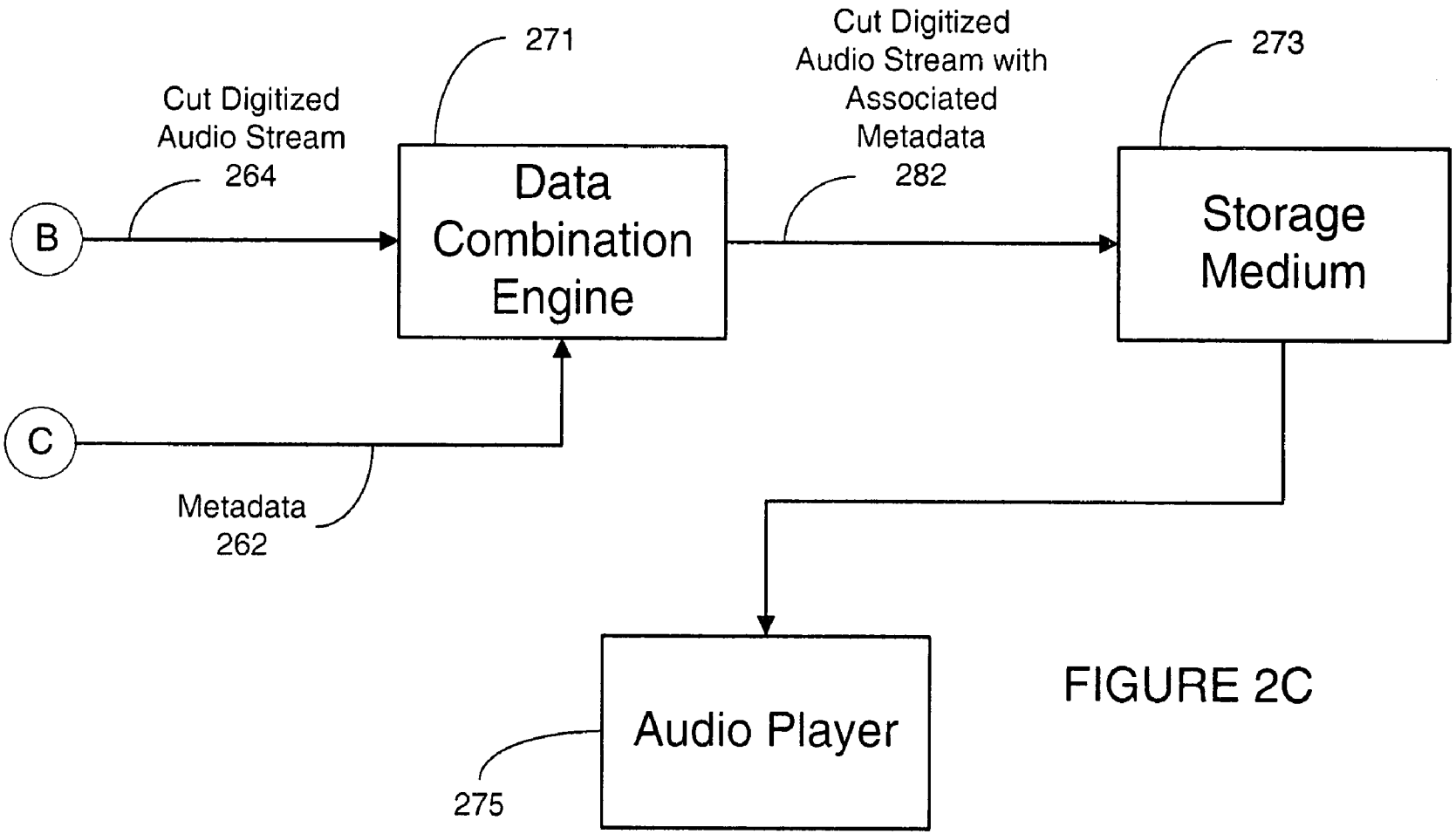

FIG. 2A illustrates a block diagram of a system for transmitting digital data with an analog audio stream in accordance with at least one aspect of the present invention. The system shown in FIG. 2A may be contained within a single device at a source end or may include multiple devices. As shown, an analog audio stream 222 is received at a signal insertion engine 205. As shown in FIGS. 2A-2C, analog audio stream 222 is shown as an analog FM transmission. Digital data 224 is also sent to the signal insertion engine 205. Digital data 224 may include both information about the analog FM transmission, such as metadata, and cutting information. Cutting information describes the starting point and ending point of an audio entity of the analog transmission. Cutting information is described in more detail below with reference to FIG. 2B.

Signal insertion engine 205 adds the digital data 224 to the analog audio stream 222. In accordance with at least one aspect of the present invention, the digital data 224 is in a subcarrier signal. The signal insertion engine 205 sends the subcarrier signal in parallel with the analog audio stream. One example of the subcarrier signal system described herein is a Data Radio Channel (DARC) system. DARC is a subcarrier system for VHF/FM radio that is compatible with Radio Data System (RDS) and Radio Broadcast Data System (RBDS) technologies. As such, aspects of the present invention may use a DARC, RDS, and/or RBDS standard. DARC has mainly been used in Japan in conjunction with radio and infrared beacons for the operation of the Vehicle Information and Communication System (VICS). In addition, it has been used in Sweden, Norway, Austria, Switzerland, South Korea and to some extent the United States. DARC occupies a bandwidth of 35 kHz centered on a subcarrier 76 kHz within the FM multiplex broadcast signal.

The gross data rate of DARC is 16 kbps. This data rate is more than 10 times the data rate capability of RDS/RBDS technology. The DARC injection level changes with the level of the audio program modulation, i.e., it is dynamic and depends precisely on the level of the stereo difference signal. DARC has been standardized by the European Telecommunication Standard Institute (ETSI) in ETS 300 751: "Radio broadcasting systems; System for Wireless Infotainment Forwarding and Teledistribution (SWIFT)". The system characteristics of DARC standard are generally described in ITU-R Recommendation BS 1194 –1[1, 2]: Systems for Multiplexing Frequency Modulation (FM) Sound Broadcasting with a Sub-carrier Data Channel Having a relatively Large Transmission capacity for Stationary and Mobile Reception.

Any DARC broadcast network allows the transmission of electronic data files on the FM radio networks at an effective data throughput of about 10 kbps. The additional 6 kbps may be utilized for error correction purposes. In a similar manner to RDS (Radio Data System) and RBDS (Radio Broadcast Data System) networks, a DARC standard network is based on existing FM infrastructure. The use of existing FM infrastructure leads to a low cost data broadcast network that can be deployed to quickly cover an entire country. Data files are exchanged between the information provider server and the DARC network server, which is controlled by the transmission network operator. The network server transmits the files to the distribution network and then towards the transmitter stations. As with RDS/RBDS networks, transmitter stations are equipped with specific DARC encoders, also called Transmitter Station Equipment (TSE). One function of the TSE is to insert the data stream in the FM baseband multiplex signal into a standardized form conforming to the International Telecommunication Union (ITU) broadcast specifications.

The electronic data files are thus multiplexed to the FM baseband signal on a sub-carrier, compatible with the RDS/RBDS subcarrier. DARC technology offers a higher bit rate than RDS/RBDS technology and DARC technology is specifically adapted to mobile and portable applications. In most cases, DARC technology operates in a severe multipath propagation environment as encountered in mountainous regions and urban areas with many high-rise buildings.

In Europe, the DARC technology was standardized in 1997 by ETSI as ETS 300 751 [3], endorsed by the Joint Technical Committee (JTC) which involves the collaboration of ETSI, the European Broadcasting Union (EBU), and the European Committee for Electrotechnical Standardisation (CENELEC). The DARC system has been aimed at a niche market in Europe, i.e., the provision of a radio data channel to small portable data receivers (made by Casio, Sharp, Sony and most recently the Swedish company Sectra) and PCs, with the receiver being implemented on a PC Card (PCMCIA) all using Japanese Integrated Circuits from Oki (MSM 9500 series) or Sanyo. Sony has its own chip (CXA 1960). These integrated circuits (IC) are now very inexpensive and cost only three times as much as RDS/RBDS decoder chips.

With reference to FIG. 2A, digital data 224, such as cutting information and metadata, are sent in a DARC signal in parallel with the analog audio stream 224 to a transmitter 207. Transmitter 207 transmits the analog audio stream and digital data using DARC, RDS, and/or RBDS standards for digital formatting as signal 236. The overall system is described further with reference to FIGS. 2B and 2C.

FIGS. 2B and 2C illustrate block diagrams of a system for receiving and processing a digital data and analog audio stream in accordance with at least one aspect of the present invention. The system shown in FIGS. 2B and 2C may be contained within a single device at a terminal or may include multiple devices. For example, the components of FIGS. 2B and 2C may be included within a terminal device, such as a set-top box, a personal video recorder (PVR), a personal digital recorder (PDR), a TV device, a radio device, a personal computer, or a mobile communication device. A central processing unit (CPU) may be included to control the overall operation of the terminal. Computer executable instructions and data used by the CPU and other components within the terminal may be stored in a computer readable memory. The memory may be implemented with any combination of read only memory modules or random access memory modules, optionally including both volatile and nonvolatile memory. Alternatively, some or all of the computer executable instructions may be embodied in hardware or firmware (not shown).

Referring to FIG. 2B, signal 236, containing the analog audio stream and digital data signal in DARC standard format, is received by an analog FM receiver 241. Analog FM receiver 241 outputs the combined signal 252 to an analog audio/digital data splitter 243. Analog audio/digital data splitter 243 operates in a similar manner as signal insertion engine 205, except to separate/split the analog audio stream 254 from the digital data 256. The analog audio stream 254 is sent through an encoder 245 where the audio stream is digitized to a digitized audio stream 258. The digitized audio stream is inputted to a cutting engine 247.

As described above with reference to FIG. 2A, digital data 224 may include both cutting information and information, metadata, about the audio stream. Similarly, one output of the analog audio/digital data splitter 243 is digital data 256. Digital data 256 may include cutting information 260 and metadata 262. Although not shown in FIG. 2B, a device may be included for operation in separating cutting information 260 from metadata 262. Analog FM receiver 241 may be configured to operate in accordance with RDS, RBDS, and/or DARC standards. Further, encoder 245 may be an Ogg Vorbis format type encoder by the Xiph.Org Foundation.

The cutting engine 247 cuts the digitized audio stream 258 into entities within a cut digitized audio stream 264 based on the cutting information 260. As described above with reference to FIG. 2A, cutting information describes the starting point and ending point of each audio entity within the digitized audio stream 258. As such, entire songs are identified by the starting and ending points for generation of the album of songs described below. The cut digitized audio stream 264 includes the digitized audio stream 258 separated by the starting and ending points of each audio entity, such as a song.

Referring to FIG. 2C, the cut digitized audio stream 264 and metadata 262 are sent to a data combination engine 271. Data combination engine 271 associates the metadata 262 for each entity in the cut digitized audio stream 264. Data combination engine 271 outputs the cut digitized audio stream with associated metadata 282 to a storage medium 273. Storage medium 273 may be contained within a terminal that also contains the receiver 241, splitter 243, encoder 245, cutting engine 247, and data combination engine 271. Alternatively, storage medium 273 may be an external storage device separate from such a terminal. Once stored, the cut digitized audio stream with associated metadata 282 can be processed, such as changing the format for display on a device and/or sorting the list of entities, to fit the needs of the user. It should be understood by those skilled in the art that every entity of the cut digitized audio stream with associated metadata need not be stored in storage medium 273. Further, a temporary storage medium may be included to allow a terminal device to record while a user and/or the system determines whether to store the song with associated metadata. For example, when listening to a radio broadcast, a user may need to hear a portion of a song before she determines that she wants to get a recording of the song. In such a case, the song and/or program may have run for 5 seconds, 15 seconds, or even minutes before the user and/or system determines that the song or program should be recorded. Therefore, in accordance with aspects of the present invention, a buffer memory may exist which records some parts of a broadcast transmission and stores that temporary memory until a determination is made to store it in storage medium 273. As such, a user can still record songs with associated metadata after the song has started playing over the speakers. Associated metadata can be continuously transmitted with the song as well. As such, the temporary memory may only be needed to store the content of the song, and when a determination is made to store the song with metadata, the associated metadata can then be associated with the song and stored in a storage medium, such as storage medium 273.

Any audio entry within the storage medium 273 and/or the cut digitized audio stream with associated metadata 282 can be sent to an audio player 275 for output to a speaker and/or display device. Audio player 275 may include a display screen and a speaker where the audio entry, e.g., song, is outputted to the speaker and the metadata information is outputted to the display screen. In accordance with at least one aspect of the present invention, a user with such a system as described with reference to FIGS. 2B and 2C can record analog music with the correct starting and stopping points and the correct metadata to arrange and retrieve the songs. The audio signal may be digitized to get a digital recording from an analog source with the correct starting and stopping points and the correct metadata. With such a system, recording from an analog radio source is automated and easier for a user. A user need not know the name of the song or artist or any other information about the audio entity since the correct metadata is already associated with the audio entity. Without the need for a user to manually enter information and/or previously stored metadata to be retrieved and associated, songs may be recorded digitally in analog quality. The arranging, listing, and finding of particular songs are simplified for a user.

Figure 3:
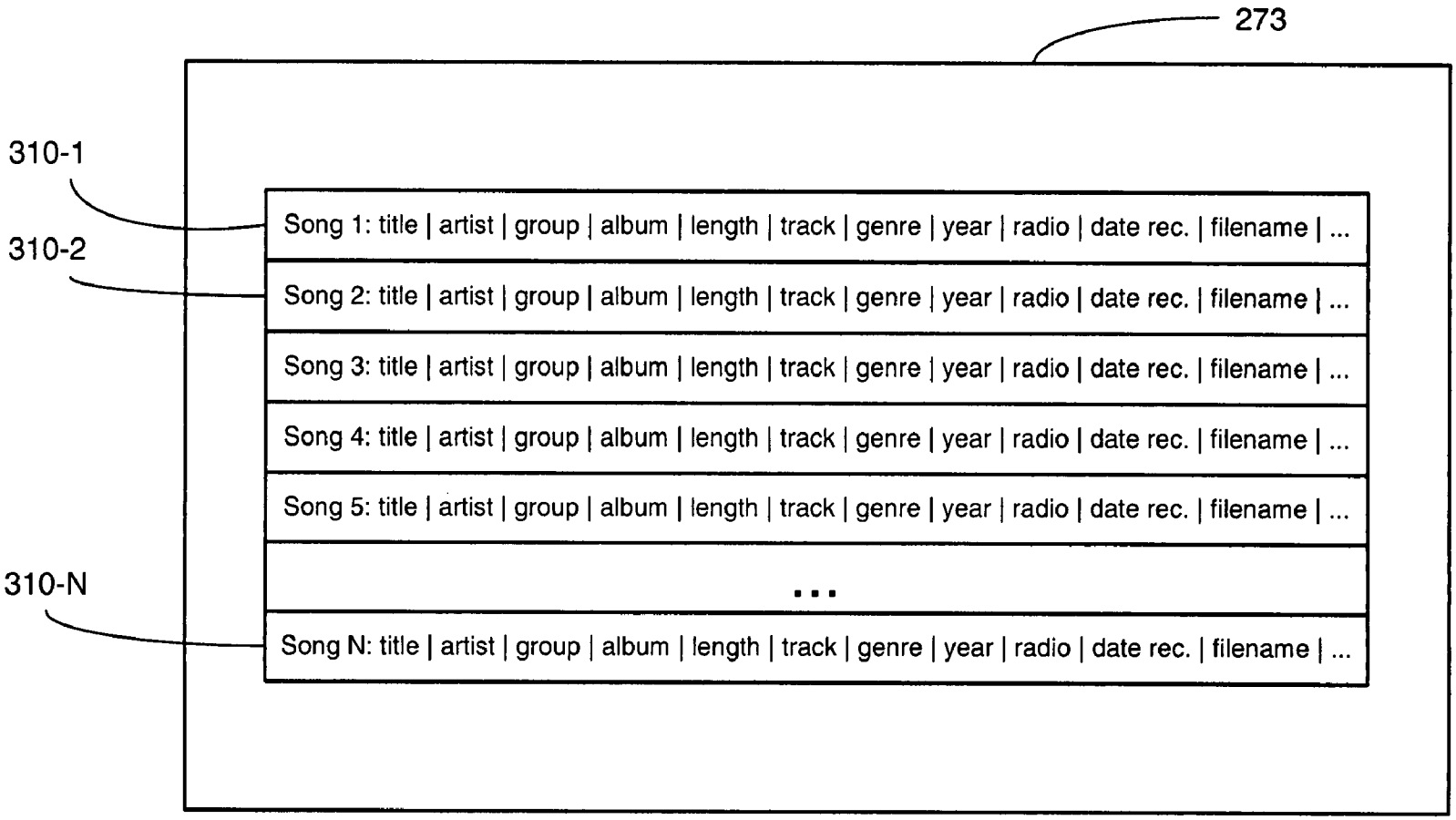
FIG. 3 illustrates a block diagram of entries in a storage medium in accordance with at least one aspect of the present invention.

With reference to FIG. 3, an illustrative example of storage medium 273 is shown in accordance with at least one aspect of the present invention. As shown, storage medium 273 includes a listing of different entities 310 of cut digitized audio that have been recorded and stored. Entities 310 may be a listing of the entities in the audio stream as received, recorded, and stored, or it may be a listing after a user and/or programmed has processed the audio entities 310 in some manner. For example, a user could arrange the stored listing in alphabetical order, delete some entries 310, switch positions of some entries 310, and/or perform some other operation on the listing of audio entries 310. Further, a user can preprogram the system to perform these operations as the audio entities are received, recorded, and stored. For example, a user can preprogram the system to record any song by a particular artist first, prior to storing other audio entities.

Audio entity 310-1 is the first audio entry 310 listed in the storage medium 273. As shown, audio entity 310-1 includes metadata that identifies the title of song 1, the artist that performs the song, the group that performs the songs (if different from and/or necessary to distinguish from the artist), the name of the album from which song 1 originates, the length of song 1, the track number of song 1 from its corresponding album, the genre of song 1, the year song 1 was recorded and/or released, the radio station from which song 1 was retrieved, the date song 1 was recorded, the filename for the entity, and/or any other information that may be desired by a user for sorting, storing, and/or identifying song 1. Any number N of audio entities 310 may be stored in storage medium 273. The number of audio entities that may be stored is only limited to the capacity of storage medium 273. Further, it should be understood by those skilled in the art that the storage capacity of storage medium 273 may be changed and/or the contents of storage medium 273 may be transferred to a different storage medium for storage and/or retrieval purposes.

Figure 4:
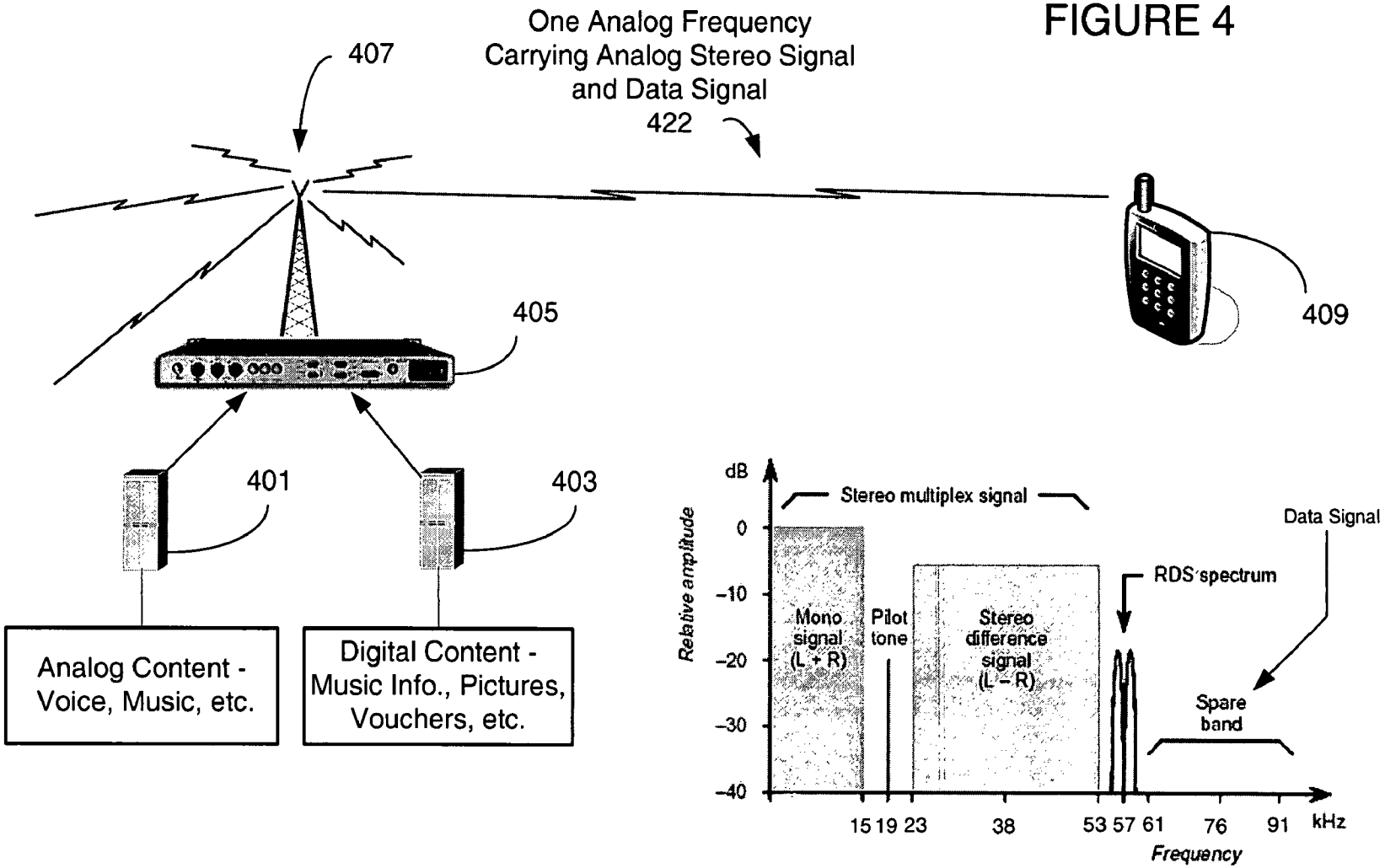
FIG. 4 illustrates a system for transmission and reception of an analog frequency carrying an analog audio signal and a data signal in accordance with at least one aspect of the present invention.

FIG. 4 illustrates a system for transmission and reception of an analog frequency carrying an analog audio signal and a data signal in accordance with at least one aspect of the present invention. As shown, analog content, such as a voice, music, or other analog signals, is sent from a server 401 to a broadcast station 405. Digital content is also sent from server 403 to the broadcast station 405. Digital content may include metadata or information about the analog content, pictures, html data, redeemable vouchers for advertising purposes, and other data. Although shown as two separate servers, it should be understood by one skilled in the art that the analog content in server 401 and digital content in server 403 may physically reside within a common device.

Broadcast station 405 combines the analog content and digital content for transmission on an analog frequency. One illustrative method and system for combining the signals is described above with reference to FIG. 2A. Broadcast station 405 can then transmit the analog stereo signal and digital data signal via one analog frequency 422 through a transmitter 407. It should be understood by those skilled in the art that components referenced by elements 401, 403, 405, and 407 may be partially and/or entirely contained and/or owned by a radio station, such as an FM radio station local to a region of country. Signal 422 may be received by terminal 409 where the audio entities within the analog stream can be associated with metadata data and/or other digital information from the digital data signal. One illustrative method and system for receiving and processing the signals is described above with reference to FIGS. 2B and 2C. As shown in FIG. 4, the analog stereo multiplex signal is shown along a certain frequency band and the data signal, such as a DARC standard, an RDBS standard, or an RDS standard data signal, occupies a higher frequency band range. Although only a single broadcast station 405 and single terminal 409 are shown in FIG. 4, it should be understood that the system may include multiple broadcast stations 405 and/or multiple terminals 409. Further, although not shown in FIG. 4, the system may include intermediate stations that receive and retransmit signal 422. Intermediate network nodes may allow for retransmission of the signal 422. It should be understood by those skilled in the art that the present invention is not so limited to a transmission of signal 422 from a broadcast station 405 directly to a terminal 409. Still further, the combination of a digital signal, such as a DARC standard digital signal, with an analog audio signal may occur after at some point of transmission between the broadcast station 405 and the terminal 409. For example, broadcast station 405 may transmit the analog audio signal to an intermediate station. The intermediate station may then combine the analog audio signal with the digital data signal and transmit to the terminal 409 and/or another intermediate node.

For a user, the digital data is sent with no additional transmission cost associated with it. The user can record a song while listening to it and can even record while not listening. For a radio station using aspects of the present invention, end users are more receptive to stay "tuned" to that radio station as it offers more services to the user. Further, in order to receive unbroken files, the user may have to stay tuned to that particular radio station. In addition, the radio station can increase advertisement revenue by transmitting vouchers and/or other advertisement material since the user is not paying for the transmission. Because the recording has been done from an analog source, a user and/or station does not need to conform and/or be concerned with any potential digital rights management (DRM) issues that pertain to digital transmissions.

Figure 5:
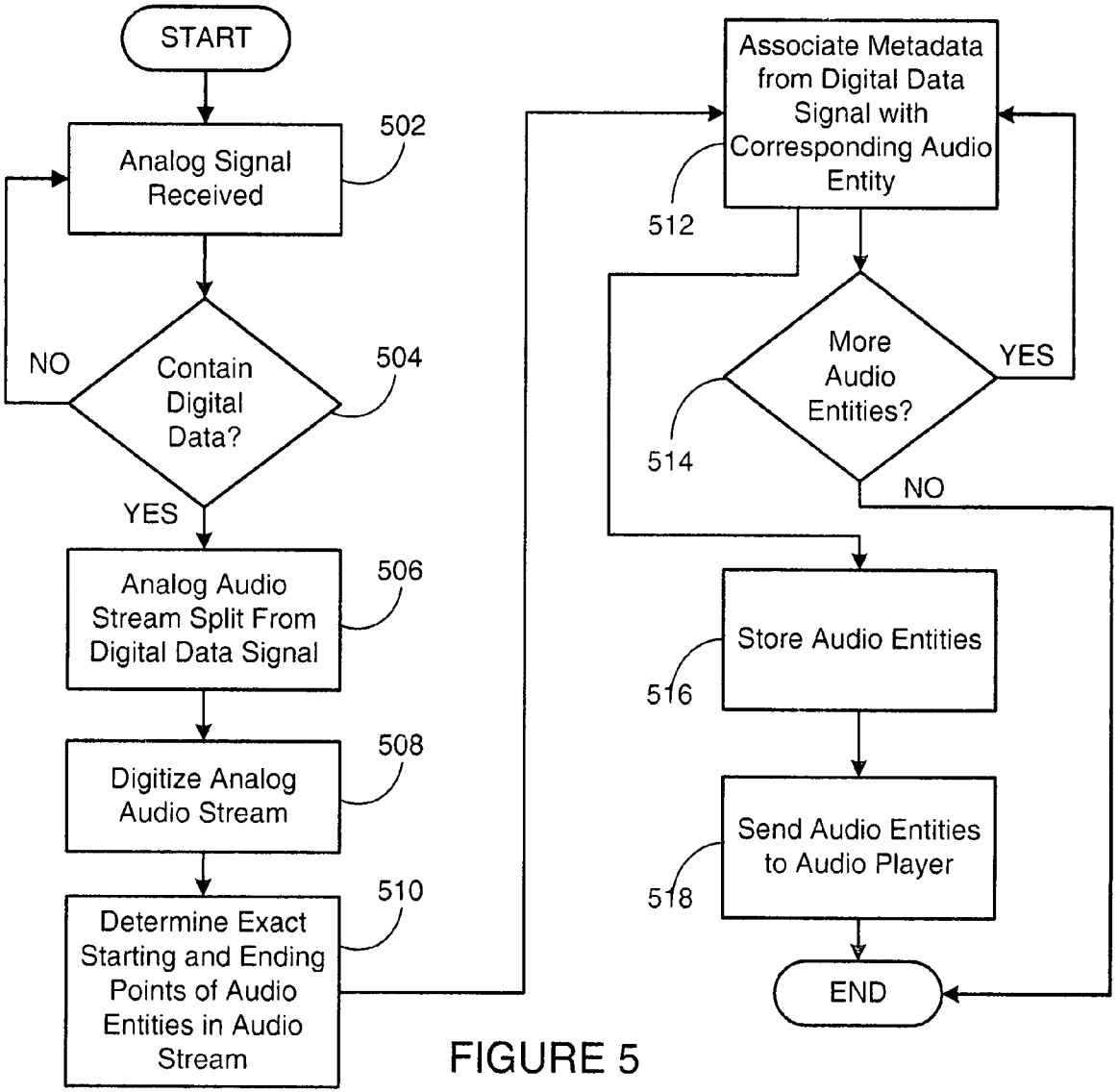
FIG. 5 illustrates a flowchart for receiving and processing a digital data and analog audio stream in accordance with at least one aspect of the present invention.

FIG. 5 illustrates a flowchart for receiving and processing a digital data and analog audio stream in accordance with at least one aspect of the present invention. The process starts at step 502 where an analog signal is received. At step 504, a determination is made as to whether the analog signal that has been received is a combination of signals and/or contains a digital data signal. If not, the process returns to step 502. If the analog signal received in step 502 does contain a separate digital data signal, at step 506, the analog audio stream is split from the digital data signal. Again, the digital data signal may be a DARC standard digital data signal that has been transmitted in parallel with the analog audio stream.

The process continues to step 508 where the analog audio stream is digitized. Once digitized, the audio stream can be saved in digital format while maintaining analog quality. At step 510, the process determines the exact starting point and ending point of each audio entity in the digitized audio stream for cutting the digitized audio stream along these points. The process may determine these points from the digital data signal containing cutting information for each entity of the digitized audio stream. With the digitized audio stream cut, at step 512, the process continues by associating metadata and/or other information obtained from the digital data signal with a corresponding audio entity. As described above, this metadata and/or other information may be an artist name, a title of song, or names of teams competing in a sports broadcast, such as the Super Bowl® of the National Football League® or Stanley Cup Finals® of the National Hockey League®

At step 514, a determination is made as to whether more entities exist that need to have metadata and/or other information associated with them. If so, the process returns to step 512 where the next audio entity is associated with its corresponding metadata. At step 516, the audio entities with associated metadata are stored in a storage medium. It should be understood by those skilled in the art that any entity that does not have corresponding digital data information to be associated with it may still be recorded and stored as an audio entity in the storage medium. The process concludes at step 518 where a user can retrieve the listing of audio entities to an audio player or other device for outputting the audio content and associated metadata. Further, although not shown in FIG. 5, a user could process the listing of audio entities within the storage medium or by use of the audio player or other device as described above with reference to FIG. 3.

Figure 6A:
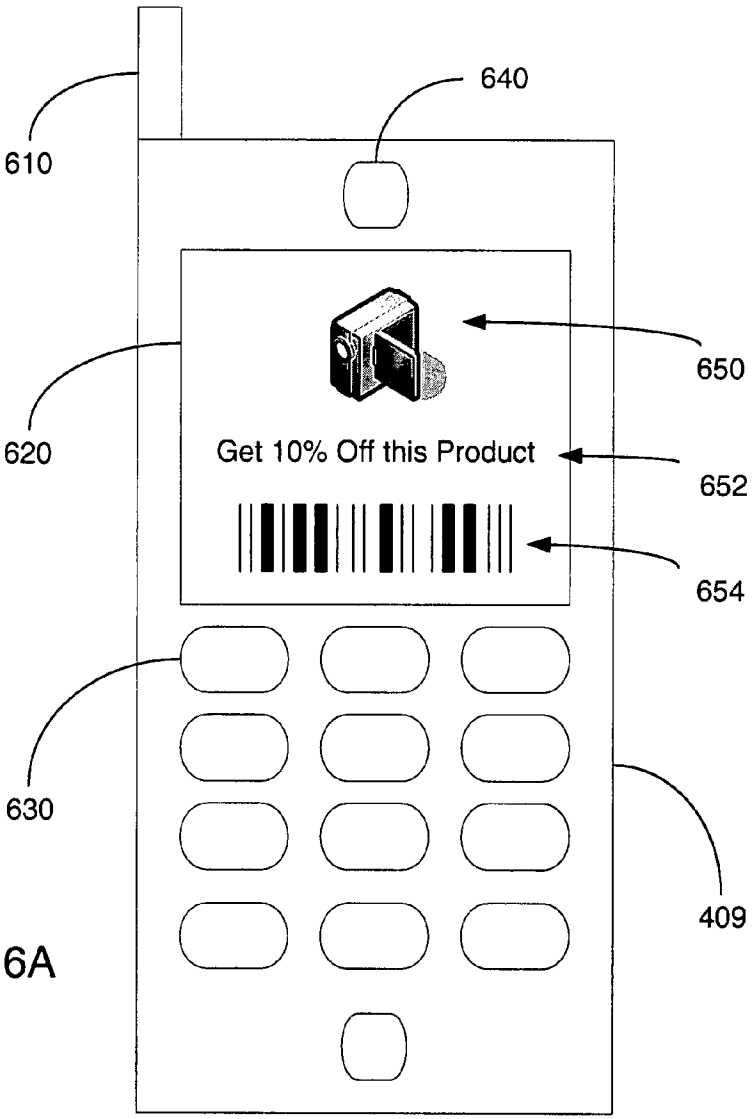
FIG. 6A illustrates a schematic diagram of a terminal displaying a voucher in accordance with at least one aspect of the present invention.

FIG. 6A illustrates a schematic diagram of a terminal displaying a voucher in accordance with at least one aspect of the present invention. The DARC standard digital signal that is combined with the analog transmission may be used to broadcast pictures, html data, and or other information, such as text, to support an audio advertisement. A radio station can use the combination signal to broadcast an audio advertisement and allow a user to obtain a voucher for listening to the advertisement. A terminal 409 is shown in FIG. 6A. Terminal 409 is shown with an antenna 610 for receiving the combined analog and digital signal. Terminal 409 includes a display area 620, an interface area 630, and a speaker 640. Terminal 409 may be any of a number of cellular phones, personal digital assistants (PDA), and/or other devices. Terminal 409 is also shown to include an advertisement in the display 620. While an audio advertisement for a product may be outputted through the speaker 640, a redeemable voucher may be displayed on display 620. As shown in FIG. 6A, the voucher includes a picture 650 of the product of the advertisement, a textual entry 652 regarding the advertisement, and a barcode 654 or other redemption code. The voucher may be machine readable. Further, a user may store the voucher for subsequent use and/or exportation to a different medium, such as printing the voucher to paper. It should be understood that the present invention is not so limited to the example shown in FIG. 6A.

The voucher shown in FIG. 6A is but one example. Different types of formats may be utilized to transmit and receive vouchers/coupons. For example, by means of a streaming format, the broadcasted data is shown on the display area 620 of the terminal 409 during the time of broadcast form the source and receipt at the terminal 409. This broadcasted data is not stored within the terminal 409. By means of a web-portal format, the broadcasted data is stored in a cache within the terminal 409. A browser within the terminal 409 can browse through the broadcasted data locally. Information databases are broadcasted with this format. Finally, a combination of the two formats may be used so that the broadcasted data is both shown on the display area 620 and stored within the terminal 409.

Other methods for transmitting and receiving a voucher/coupon may be used. For example, a voucher may be transmitted in parallel to an audio advertisement or even independent from the audio signal. The voucher is broadcasted via the digital RDS/RBDS/DARC standard signal. At the terminal 409 of the user, the digital signal is detected and shown on the display area 620. The audio advertisement is played through a speaker 640 of the terminal 409 while the voucher is displayed on the display area 620. A user may preprogram her terminal 409 to allow for audio advertisements to be received and played on her terminal 409 but not to display vouchers on the display area 620. Alternatively, she may preprogram her terminal 409 to allow for vouchers to be displayed on the display area 620 of her terminal 409 but not to output the audio advertisement through the speaker 640.

As shown in FIG. 6A, the voucher may be a picture 650 of a product with a tag to be shown on the display area 620 and stored within a memory of the terminal 409. The voucher may be a still image 650 displaying the store which issued the voucher along with textual entry 652 to lead the user to the store. Once at the store, the user may use the voucher to receive a discount on a product or service, a free gift, and/or a service. In another example, the voucher may be a still image having a machine readable code integrated within the voucher, such as the barcode 654 shown in FIG. 6A. The voucher may then be read at a store to receive a discount on a product or service, a free gift, and/or a service. A reader at the store can also verify the validity of the voucher and/or obtain other information, such as whether the voucher has already been redeemed, information about the user of the terminal 409, and/or information about the terminal 409. The voucher may be a still image with a limited time for using and/or limited amount of time for display before deletion.

In another embodiment, the voucher may be an animated image including some or all of the features described herein. For example, the voucher may be an animated image of the product and further include textual entry, such as textual entry 52, and a barcode, such as barcode 654. In still another embodiment, the voucher may be a still image having a direct link to a server using the Global System for Mobile Communications/General Packet Radio Service/Third generation Mobile System (GSM/GPRS/3G) back-channel of the terminal 409. Under this embodiment, a verification may be made that the user is actually listening to and or watching the advertisement. For example, an audio, textual, and/or video output may inform the user that she will now see the voucher on the display area 620, and if she answers a question within a specified time period, she will receive a discount off a product from the store sending the voucher. In another example, an audio, textual, and/or video output may inform the user that she will now see the voucher on the display area 620, and if she enters an input on her interface area 630, she will receive a discount from the store. The input entry may be configured to activate the GSM/GPRS/3G back-channel of the terminal 409.

Figure 6B:
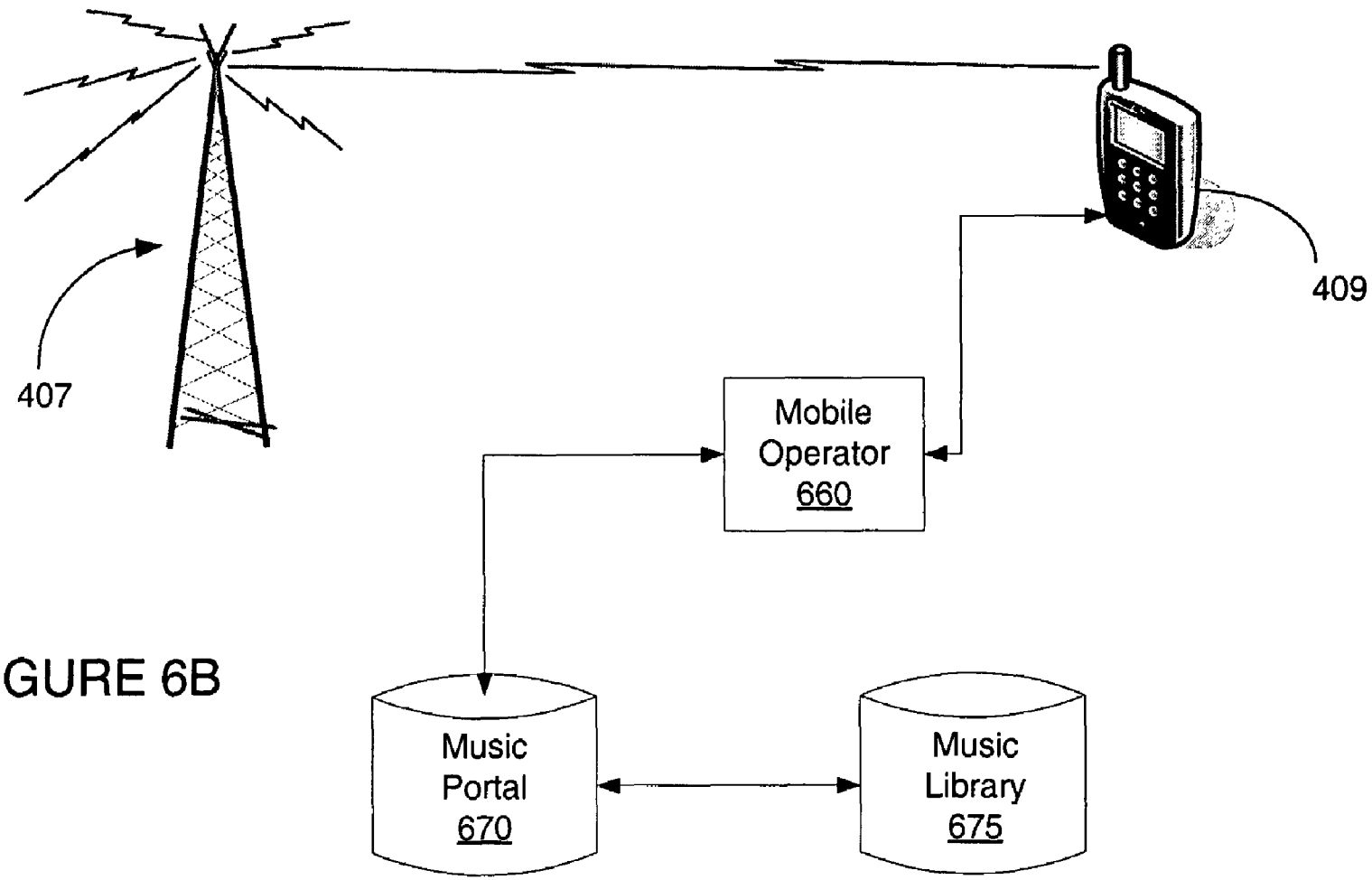
FIG. 6B illustrates a system for transmission and reception of an analog frequency carrying an analog signal and a data signal in accordance with at least one aspect of the present invention.

FIG. 6B illustrates a system for transmission and reception of an analog frequency carrying an analog audio signal and a digital data signal in accordance with at least one aspect of the present invention. A broadcast station transmits an analog signal and digital data signal via a combined signal through a transmitter 407. The combined signal may be received by a terminal 409 where the audio entities within the analog stream can be associated with metadata data and/or other digital information from the digital data signal. A display on the terminal 409 may show the name of the broadcast station transmitting the combined signal, such as "WOFF—103.5FM", and the name of the song currently being transmitted. The data used for display purposes may be obtained from the digital data in the combined signal.

Terminal 409 is shown to be in contact with a mobile operator 660. The mobile operator 660 is shown in contact with a music portal 670 and the music portal is shown in contact with a music library 675. There are a number of different methods for connection and/or communication between reference elements 409, 660, 670, and 675. For example, terminal 409 may be in contact with music portal 670 through mobile operator 660 by means of a short message service (SMS) or a uniform/universal resource locator (URL) service available on many mobile terminals. Music portal 670 coordinates the interface to the terminal 409 and the music library 675. Music portal 670 may request specific data from the music library 675 based upon the name of the song received in the SMS message form terminal 409. Music library 675 retrieves the additional information, such as the name of the artist that performs the song, the album name, the track number, the length of the song, the date of release, etc. and sends that information to the terminal 409 through the music portal 670.

Mobile operator 660 also may be a service provider or broker that coordinates requests to purchase products and/or services. For example, a user at mobile terminal 409 hears a song being transmitted from transmitter 407 by a broadcast station. Upon hearing the song, the user may desire to obtain a copy of the song. By user of her mobile terminal 409, the user can request to obtain a copy of the song being played. The mobile operator 660 receives the request and coordinates the purchase of the song by contacting the music portal 670 and/or music library 675. The mobile operator 660 obtains enough information about the song from the music portal 670 and/or music library 675 to coordinate the purchase of the song. Mobile operator 660 may coordinate the purchase through obtaining an authorization, such as a purchase ticket, to download a copy of the song form a source, such as directly from the broadcast station or a database on the Internet.

Figure 6C:
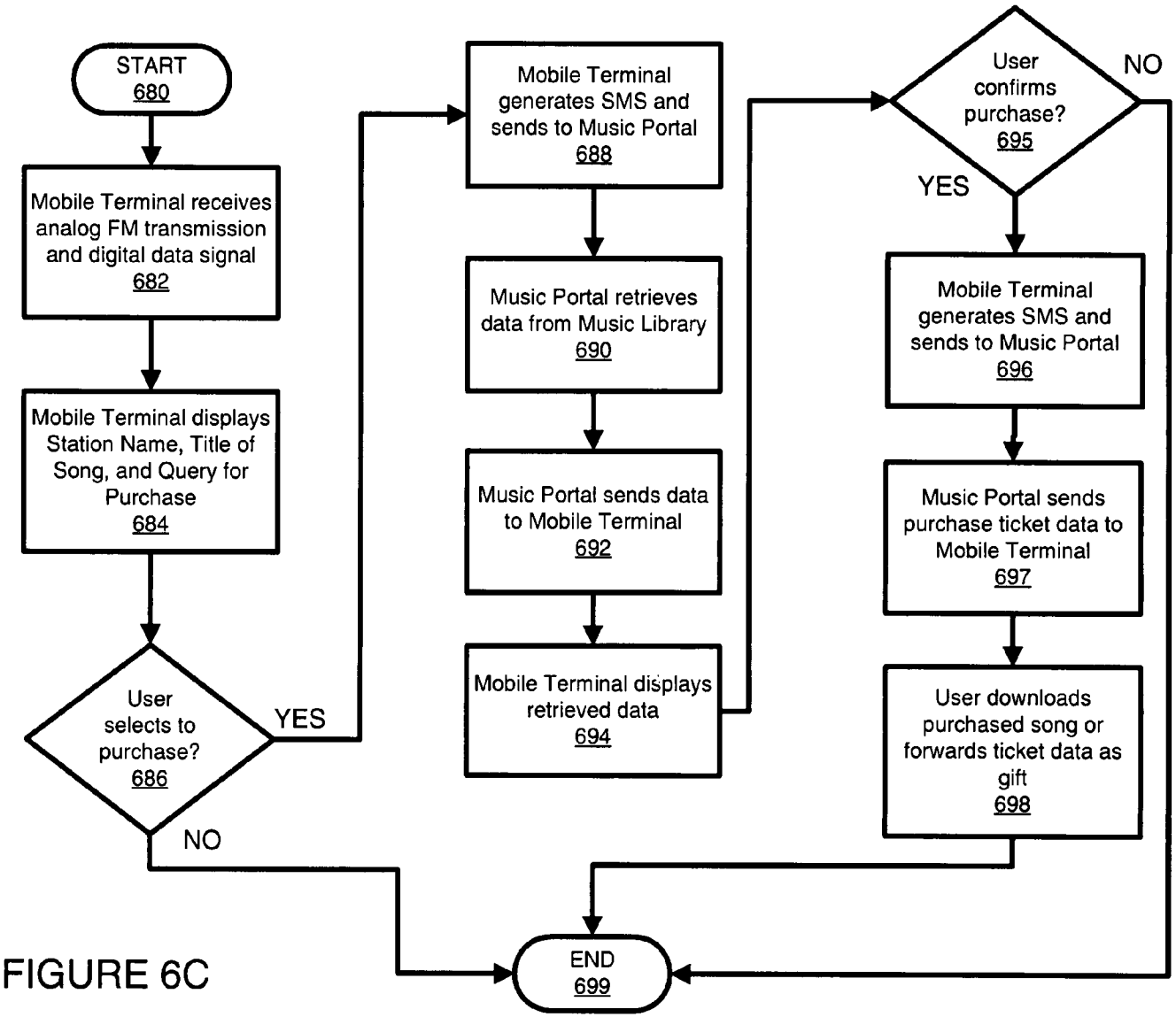
FIG. 6C illustrates a flowchart for processing an analog audio stream in accordance with at least one aspect of the present invention.

FIG. 6C illustrates a flowchart for processing an analog audio stream in accordance with at least one aspect of the present invention. In one embodiment, FIG. 6C illustrates operation of the system shown in FIG. 6B. The process starts at step 680 and proceeds to step 682 where a mobile terminal, such as terminal 409, receives a combined analog FM transmission and digital data signal. This combined signal may be the signal sent through transmitter 407. At step 684, the mobile terminal displays information about the current song or program being transmitted. For example, the mobile terminal may display the name of the station broadcasting the song, the title of the song itself, and a query to whether the user desires to purchase a copy of the song. The query may also be for detailed information of the content of the song and/or program. Still further, both a query to purchase and a query for detailed information may be displayed. The process continues and at step 686, a determination is made as to whether the user has selected to purchase the song in response to the query. If not, the process ends 699. If the user does select to purchase the song, the process continues to step 688.

At step 688, the mobile terminal generates an SMS message and sends the message to a music portal, such as music portal 670. Such an action to select to purchase may be triggered by a press on a keypad of the mobile terminal. The mobile terminal may then generate the SMS message and send the message in step 688. At step 690, the music portal retrieves data from a music library, such as music library 675. The music library may contain a number of types of information associated with a song. The music library may receive the title of the song from the music portal and retrieve information re the artist name, track length, album name, year of release, etc. and send that information/metadata to the music portal. At step 692, the music portal transmits the retrieved metadata/information to the mobile terminal. The mobile terminal may then display the retrieved metadata/information at step 694. A determination may then be made to confirm whether the user still desires to purchase the song at step 695. For example, the user may see the artists name and realize that she does not want to purchase the song. If confirmation to purchase is not received, the process ends 699. If confirmation to purchase is received, the process proceeds to step 696.

At step 696, the mobile terminal generates and sends an SMS message to the music portal of the confirmation. At step 697, the music portal sends a purchase ticket to the mobile terminal. The purchase ticket may be a SMS message containing a URL and an authorization code to download the song. At step 698, the user of the mobile terminal can choose to download the purchased song immediately via a General Packet Radio Service (GPRS) system or at a later time on an Internet connection from a different terminal, such as a home PC. The user could also send the purchase ticket to another individual as a gift and that individual can retrieved the purchased song and/or program in the same manner.

Figure 7:
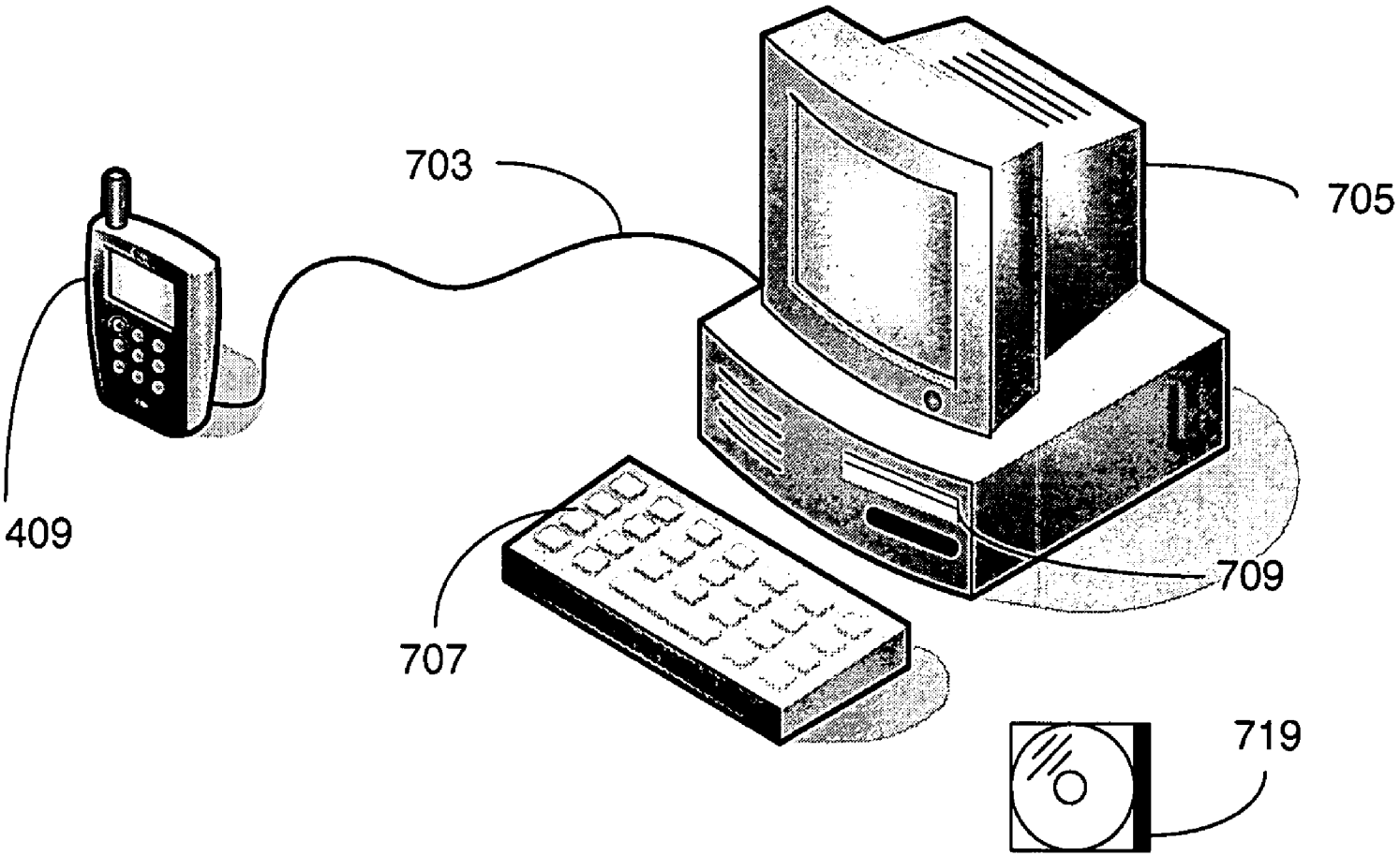
FIG. 7 illustrates a system for copying of a stored album of audio content in accordance with at least one aspect of the present invention.

FIG. 7 illustrates a system for copying a stored listing of audio content in accordance with at least one aspect of the present invention. Similar to the ability to copy songs broadcasted from a radio station to cassette tapes for private usage, a user may copy audio entities with associated metadata to a storage medium for private usage as well. As shown in FIG. 7, terminal 409 may be connected to a personal computer (PC) 705 by means of a connection 703. Connection 703 may be a USB port type connection, or may be a Bluetooth connection. PC 705 includes a keyboard 707. With keyboard 707, a user can manually modify the metadata associated with each audio entity and/or can manipulate the listing/album of entries. For example, a user can sort the album by artist, by genre, or by other criteria. A user could change the order of play and/or the order for copying to a storage medium. As shown, PC 705 includes a writable compact disc drive 709 where a user may insert a compact disc, such as compact disc 719, to copy a listing of audio entities and associated metadata to the compact disc 719. Once copied, the user can use the compact disc 719 privately in an external audio device, such as in her car or stereo system. Other methods for copying an audio album should be understood by those skilled in the art and the example illustrated in FIG. 7 is but one example.

Figure 8:
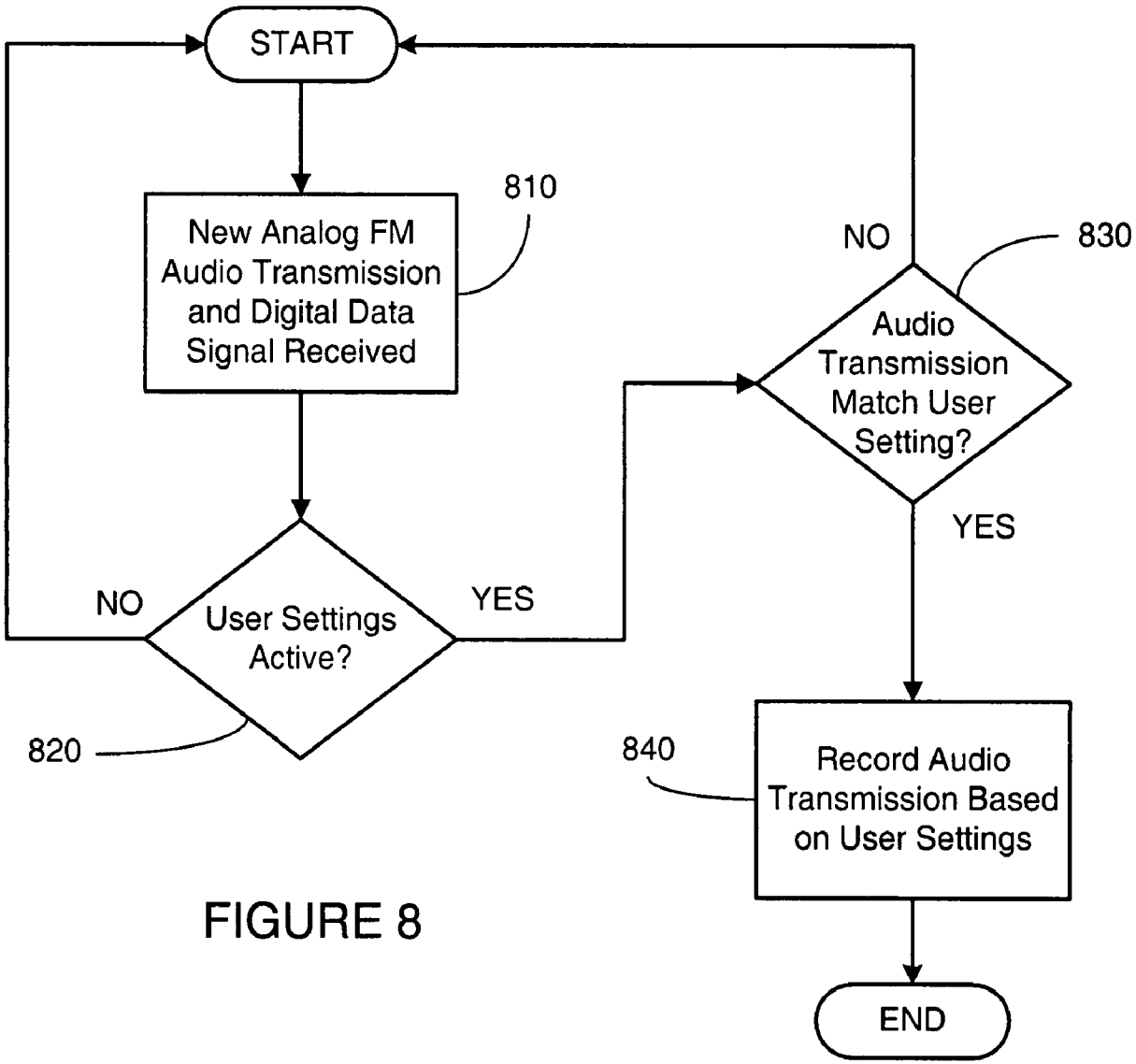
FIG. 8 illustrates a flowchart for processing an analog audio stream in accordance with at least one aspect of the present invention.

FIG. 8 illustrates a flowchart for processing an analog audio stream in accordance with at least one aspect of the present invention. As shown, a user can predefine settings on a terminal for recording audio content and associating metadata and/or other information to the audio content. The process begins at step 810 where a new analog FM audio transmission and digital data signal is received. A new analog FM transmission may be a new song being played by the radio station and/or a different radio station altogether. At step 820, a determination is made as to whether the user has activated any predefined user settings. A user might not be listening to a broadcast, but may still wish to record certain audio content, such as a favorite radio program to be aired. If the user has no settings in place, the process starts over again. If the user does have a setting in place, the process continues to step 830. One setting may be to record a favorite radio station and/or specific program, such as a show or sporting event, or to record songs by specific artists, etc.

At step 830, another determination is made as to whether the new FM audio transmission matches any criteria of the user settings. For example, if the user only wishes to record a certain radio program and the new FM audio transmission does not include the specified radio program, there is no match at step 830. If a match is not found, the process starts again. However, if a match is found in step 830, the process proceeds to step 840 where the audio transmission is recorded and stored in accordance with the user settings.

One skilled in the art will understand that although the Figures make reference to an analog FM transmission of an audio stream, the present invention is not so limited to analog FM transmissions and is directed to any type of analog transmission for communication purposes.

One or more aspects of the invention may be embodied in computer-executable instructions, such as in one or more program modules, executed by one or more computers, set top boxes, mobile terminals, or other devices. Generally, program modules include routines, programs, objects, components, data structures, etc. that perform particular tasks or implement particular abstract data types when executed by a processor in a computer or other device. The computer executable instructions may be stored on a computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like.

Although the invention has been defined using the appended claims, these claims are exemplary in that the invention may be intended to include the elements and steps described herein in any combination or sub combination. Accordingly, there are any number of alternative combinations for defining the invention, which incorporate one or more elements from the specification, including the description, claims, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention. It may be intended that the written description of the invention contained herein covers all such modifications and alterations.

I claim:

1. A method comprising:

receiving a combined signal including a digital data component and an analog component;

separating the combined signal into the digital data component and the analog component;

digitizing the analog component;

determining a starting point and ending point of one or more audio entities in the digitized analog component based upon information in the digital data component; and associating the digitized analog component with data from the digital data component to create an album of audio content comprising the one or more audio entities.

2. The method of claim 1, further comprising storing the album of audio content in a storage medium.

3. The method of claim 1, further comprising sending the album of audio content to an audio player.

4. The method of claim 1, wherein the digital data component includes cutting information and metadata.

5. The method of claim 4, wherein the cutting information includes information about the starting point and ending point of audio content within the digitized analog component.

6. The method of claim 1, wherein the analog component is an analog frequency modulation signal.

7. The method of claim 1, wherein the digital data component is a subcarrier signal in accordance with the DARC standard.

8. The method of claim 1, wherein the digital data component is a subcarrier signal in accordance with the RBDS standard.

9. The method of claim 1, wherein the digital data component comprises metadata corresponding to one or more of an artist or song title of an audio entity in the digitized audio component.

10. The method of claim 1, wherein the digital data component comprises an image corresponding to an audio entity in the digitized audio component.

11. An apparatus, comprising:

a receiver configured to receive a combined analog signal and subcarrier signal;

a processor configured to control the operation of the apparatus, the processor configured to process the received subcarrier signal and analog signal by software programmed to generate an album of audio content;

an encoder configured to digitize the analog signal;

a cutting engine configured to determine a staffing point and ending point of one or more audio entities in the digitized analog signal based upon cutting information within the subcarrier signal;

a digital player configured to output the album of audio content comprising the one or more audio entities;

a storage medium configured to store the album of audio content;

a display configured to show information relating to the album; and an interface configured to allow a user to interface with the apparatus.

12. The apparatus of claim 11, wherein the subcarrier signal is a digital data signal in accordance with the DARC standard.

13. The apparatus of claim 11, wherein the subcarrier signal is a digital data signal in accordance with the RBDS standard.

14. The apparatus of claim 11, wherein the album of audio content is a listing of audio entities and associated information about the audio entities.

15. The apparatus of claim 11, wherein the interface is configured to allow the user to modify the album of audio content.

16. The apparatus of claim 15, wherein the modification of the album of audio content comprises at least one of: sorting, deleting an audio entity in the album, and changing the information relating to an audio entity in the album.

17. The apparatus of claim 11, wherein the analog signal is a frequency modulated analog signal.

18. The apparatus of claim 11, further comprising a splitter configured to separate the analog signal from the subcarrier signal.

19. The apparatus of claim 11, wherein the cutting information includes information about the staffing point and ending point of audio content within the digitized analog signal.

20. The apparatus of claim 19, wherein the album is a listing of the cut digitized analog signal with associated information from the subcarrier signal.

21. The apparatus of claim 11, wherein the apparatus comprises a cellular phone.

22. The apparatus of claim 11, wherein the subcarrier signal comprises metadata corresponding to one or more of an artist or song title of an audio entity in the digitized audio signal.

23. The apparatus of claim 11, wherein the subcarrier signal comprises an image corresponding to an audio entity in the digitized audio signal.

24. A computer-readable medium having computer-executable instructions that, when executed, perform:

receiving a combined signal including a digital data component and an analog component;

separating the combined signal into the digital data component and the analog component;

digitizing the analog component;

determining a starting point and ending point of one or more audio entities in the digitized analog component based upon information in the digital data component; and associating the digitized analog component with data from the digital data component to create an album of audio content comprising the one or more audio entities.

25. The computer-readable medium of claim 24, the instructions when executed further perform storing the album of audio content in a storage medium.

26. The computer-readable medium of claim 24, wherein the digital component is a subcarrier signal in accordance with the DARC standard.

27. The computer-readable medium of claim 24, wherein the digital component is a subcarrier signal in accordance with the RBDS standard.

28. A method comprising:

receiving an analog audio stream;

receiving digital data comprising information identifying a starting point and ending point of one or more audio entities in the analog audio stream;

generating a combined signal including a digital data component corresponding to the received digital data and an analog component corresponding to the analog audio stream, wherein the information identifying the starting point and ending point of the one or more audio entities in the analog audio stream is included within the digital data component, and wherein the digital data component further comprises metadata corresponding to song information of an audio entity in the analog audio stream, and wherein the combined signal is transmitted in accordance with one of the RBDS standard and the DARC standard; and transmitting the combined signal.

29. An apparatus, comprising:

a processor configured to control at least some operations of the apparatus;

a signal insertion engine configured to:

receive an analog audio stream;

receive digital data comprising information identifying a starting point and ending point of one or more audio entities in the analog audio stream;

generate a combined signal including a digital data component corresponding to the received digital data and an analog component corresponding to the analog audio stream, wherein the information identifying the staffing point and ending point of the one or more audio entities in the analog audio stream is included within the digital data component, and wherein the digital data component further comprises metadata corresponding to song information of an audio entity in the analog audio stream, and wherein the combined signal is transmitted in accordance with one of the RBDS standard and the DARC standard; and transmit the combined signal.

* * * * *

UNITED STATES PATENT AND TRADEMARK OFFICE

CERTIFICATE OF CORRECTION

PATENT NO. : 7,551,889 B2
APPLICATION NO. : 10/879126
DATED : June 23, 2009
INVENTOR(S) : Quelle It is certified that error appears in the above-identified patent and that said Letters Patent is hereby corrected as shown below:

In Column 13, Claim 11, Line 52 and In Column 14, Claim 19, Line 20:
Please replace "staffing" with --starting--

Signed and Sealed this

Nineteenth Day of January, 2010

David J. Kappos

David J. Kappos
*Director of the United States Patent and Trademark Office*